United States Patent [19]

Janszen

[11] 4,382,328

[45] May 10, 1983

[54] METHOD OF MAKING STATIONARY ELECTRODES FOR ELECTROSTATIC TRANSDUCERS

[76] Inventor: Arthur A. Janszen, 34 Oak Ave., Belmont, Mass. 02178

[21] Appl. No.: 221,991

[22] Filed: Jan. 2, 1981

[51] Int. Cl.[3] ..... H04R 31/00

[52] U.S. Cl. ..... 29/594; 29/825; 179/111 R

[58] Field of Search ..... 179/111 R, 111 E; 361/283, 278; 29/594, 602 A, 848, 825

[56] References Cited

U.S. PATENT DOCUMENTS

| | | | |
|---|---|---|---|
| 3,892,927 | 7/1975 | Lindenberg | 179/111 R |
| 3,894,333 | 7/1975 | Chang | 29/594 |
| 3,993,939 | 11/1976 | Slavin et al. | 361/283 |

*Primary Examiner*—Carl E. Hall

*Assistant Examiner*—P. W. Echols

*Attorney, Agent, or Firm*—Kenway & Jenney

[57] ABSTRACT

In the method disclosed herein, a nonconductive plastic frame is utilized which provides a planar face portion, there being a plurality of recesses distributed over the face. Selective areas of the face are coated with a conductive layer, avoiding the recesses. An adhesive is then coated over essentially the entire face portion, including at least the margins of the recesses. A film of a high dielectric strength polymer is placed over the face portion and this film is locally distorted into each of the recesses so as to, in effect, wrap the film around the margin of each of the recesses and to then puncture the film centrally in each recess. Electrodes constructed in this fashion are utilized in electrostatic transducers by assembling a pair of such electrodes in face-to-face relationship, together with an intervening diaphragmatic movable electrode.

10 Claims, 13 Drawing Figures

METHOD OF MAKING STATIONARY ELECTRODES FOR ELECTROSTATIC TRANSDUCERS

BACKGROUND OF THE INVENTION

The present invention relates to electrostatic transducers and more particularly to a method of making stationary electrodes for use in such transducers.

In the making of electrostatic transducers, e.g. high fidelity tweeters, an ongoing area of concern has been the fabrication of satisfactory stationary electrodes. In typical transducer arrangements, a pair of stationary electrodes are employed, one on either side of a diaphragmatic movable electrode. In order to obtain the greatest efficiency, the spacing between the movable electrode and the stationary electrode should be as small as possible and yet electrical breakdown between the electrodes should be prevented. These considerations indicate that the operative portion of the stationary electrode should be as flat as possible and should be insulated by a dieletric layer which is as thin as possible. As is understood, the stationary electrode should also offer substantial acoustic transparency so as to permit the radiation of acoustic energy generated by the movable electrodes. Prior approaches to constructing a stationary electrode are represented in my earlier U.S. Pat. Nos. 2,631,196, 2,896,025 and 3,800,102. In each of these arrangements, insulated wires were formed into flat, accoustically transparent structures and supported so as to constitute the stationary electrodes in an electrostatic transducer. While providing satisfactory constructions, each of these techniques involve relatively complex fabrication or delicate fabrication techniques.

Among the several objects of the present invention may be noted the provision of a method for making stationary electrodes which is adapted to relatively simple and inexpensive manufacturing techniques; the provision of such a method which produces electrodes whose active portions possess a high degree of flatness and can therefore be mounted in close proximity to movable electrodes; the provision of such a method which provides a high degree of dielectric protection for the active portions of the stationary electrodes so that breakdowns are eliminated; and the provision of such a method which is relatively simple and inexpensive. Other objects and features will be in part apparent and in part pointed out hereinafter.

SUMMARY OF THE INVENTION

In the method disclosed herein, a nonconductive frame is utilized which includes a planar face portion, there being a plurality of recesses distributed over the face. Selective areas of the face are coated with a conductive layer, avoiding the recesses. An adhesive is then coated over essentially the entire face portion, including at least the margins of the recesses. A film of a high dielectric strength polymer is placed over the face portion and this film is locally distorted into each of the recesses so as to, in effect, wrap the film around the margin of each of the recesses and to then puncture the film centrally in each recess. Electrodes constructed in this fashion are utilized in electrostatic transducers by assembling a pair of such electrodes in face-to-face relationship together with an intervening diaphragmatic movable electrode.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
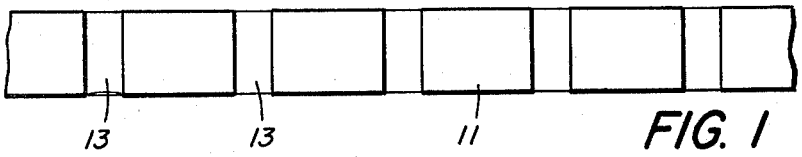
FIGS. 1–6 illustrate successive stages in the making of a stationary electrode in accordance with the present invention, using a perforated electrode frame having relatively straightsided perforation.

Referring now to FIG. 1 there is indicated at 11 a flat insulating panel provided over its surface with a plurality of essentially straightsided recesses or apertures 13. For the purposes of the present invention the apertures 13 may conveniently be considered to be bottomless recesses as that latter term is used in the claims. The material for board 11 may, for example, be a reinforced phenolic and the overall panel may be of the type frequently designated as "perf" board and sold for electronic prototyping purposes.

Figure 2:
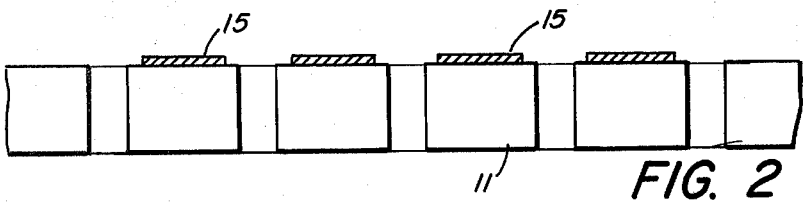
Figure 3:
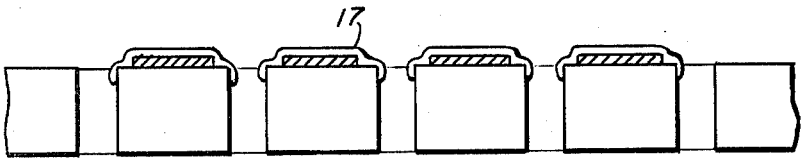

As illustrated in FIG. 2, a conductive paint is applied, e.g. by silk screening, to selective portions of the face of panel 11 between the apertures 13, leaving a margin adjacent the apertures or recesses so that the conductive material is spaced back from the recesses. A contact adhesive is then sprayed over the face of the panel so as to provide a coating 17 which covers not only the conductive portions 15 but also the margins of the recesses 13.

Figure 4:
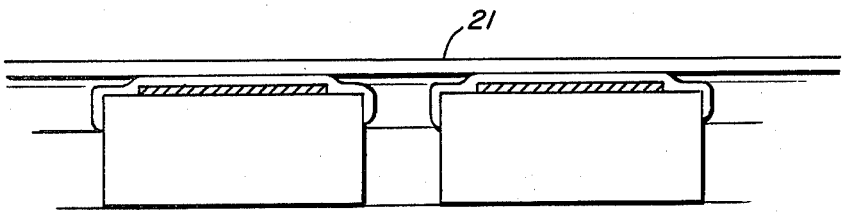

A film 21 of a high dielectric strength polymer is then placed over the face of the panel as illustrated in FIG. 4 and is pressed against the adhesive so as to be held thereby. A preferred form of dielectric film is the polyvinyl fluoride film sold by the DuPont Company of Wilmington, Delaware under its trademark TEDLAR. This film material has the high dielectric strength desired and is formable in accordance with the succeeding steps of the present method.

Figure 5:
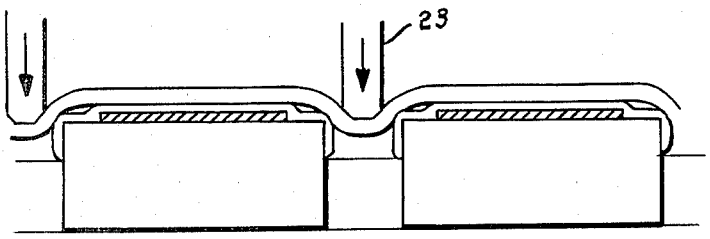
Figure 6:
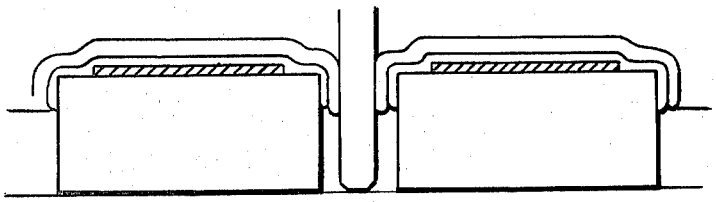

As illustrated in FIG. 5, the portions of the film 21 overlying the recesses 13 are then deformed into the recesses by a tool 23 causing the film to, in effect, wrap around the margin of each recess. After the film 21 has been locally deformed as just described, the center portion of the film overlying the aperture 13 is then perforated as illustrated in FIG. 6. While it is presently preferred that the deforming and perforating be done by separate tools, the first rounded and the second more pointed, it should be understood that the use of a single tool for both phases is also contemplated.

As will be understood from the foregoing description, an electrode construction is obtained in which the conductive elements 15 are completely overlaid by high dielectric strength material and that this dielectric film is further wrapped around the margin of each of the apertures which provide acoustic transparency. This desirable result is obtained without interfering with or affecting the inherent flatness of the original panel.

Figure 7:
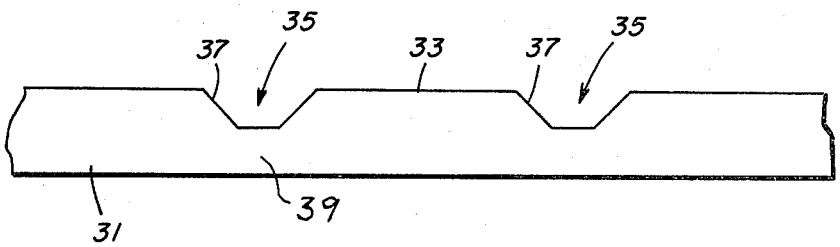
FIGS. 7–12 represent successive stages in making a stationary electrode in accordance with the present invention, utilizing an electrode frame provided with conical recesses.

While the method illustrated in FIGS. 1–6 permits the utilization of quite readily available perforate panels, it does require that the conductive coating on the panel be applied by a silk screening procedure so as to provide an uncoated margin adjacent each of the relatively straight-sided apertures 13. By using a specially designed panel molding, this necessity for silk screening can be avoided and a stationary electrode in accordance with the present invention may be constructed as illustrated in FIGS. 7–12. The electrode frame 31 illustrated in FIG. 7 provides a flat working face 33 over which are scattered a number of recesses 35. Rather than being essentially straightsided and extending completely through the panel, the recesses 35 include a generally conically shaped portion 37 and terminate in a thin bottom portion 39. As will be apparent hereinafter, the conical portion acts as a margin around the conductive elements subsequently formed on the front face 33.

Figure 8:
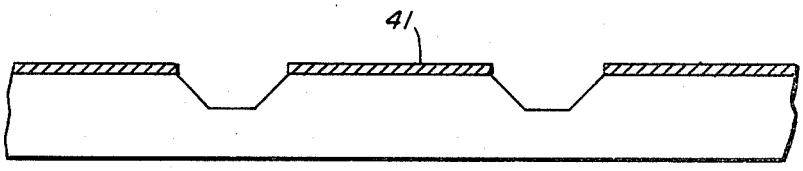
Figure 9:
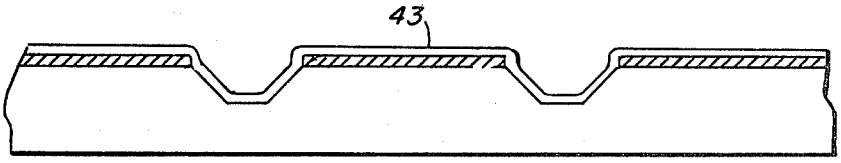

As illustrated in FIG. 8 a conductive coating 41 is applied to the selected portions of the face 33 of panel 31. In this construction, the conductive coating 41 can extend up to the conical portion of the recess 37 and thus may be applied by a simpler roller application process, rather than by a more complicated silk screening process. It should be understood, however, that a silk screen process might also be used. An adhesive is then sprayed over the panel as illustrated in FIG. 9, covering not only the conductive coating 41 but also the margin and the rest of the recess. This coating is indicated by reference character 43.

Figure 10:
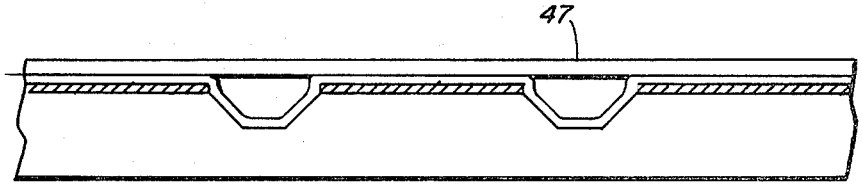

After the adhesive is applied, a film 47 of high dielectric polymer is placed over the panel as illustrated in FIG. 10 and is pressed against the adhesive so as to be held thereby. Again the preferred material for the insulating film is polyvinyl fluoride.

Figure 11:
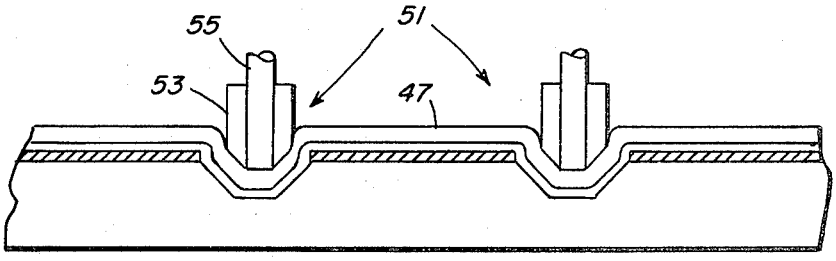
Figure 12:
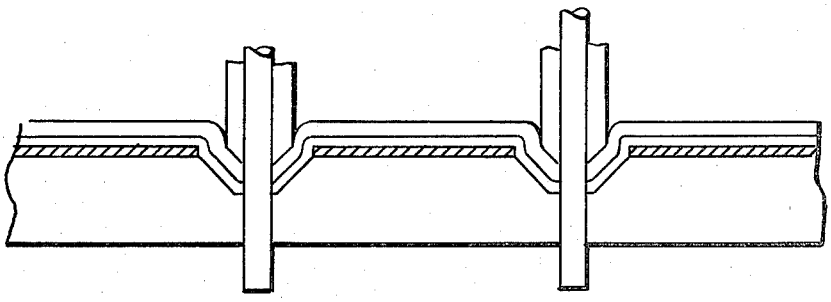

As illustrated in FIGS. 11 and 12, a two stage tool, indicated generally by reference character 51, is employed to both locally deform and to perforate the dielectric film. The tool 51 comprises both an outer annular part 53 having a conical surface which approximately matches the recesses 37 and an inner cylindrical part 55. In the first stage of operation, illustrated in FIG. 11, the annular portion 53 is driven into the recess so as to locally deform the dielectric film 47 and wrap it against the conical margin. Thereafter, the progressive operation of the tool causes the cylindrical inner portion 55 to drive through and perforate the dielectric film and to punch out the bottom of the recess 35 as illustrated in FIG.12. As will be understood by those skilled in the art, a backing tool or die may be provided up against the back of the panel to support the back of the panel if all points on a large electrode surface are to be operated on simultaneously. While a multiple tool which will punch through a plurality of points in one operation is contemplated, e.g. processing a row of recesses at one time, it is also contemplated that a single tool might be used which is repetitively stepped around the electrode surface, e.g. by a numerical controller.

Again, it will be understood that the method of the present invention results in a stationary electrode structure in which a high dielectric strength film overlays the conductive elements and essentially wraps around them utilizing a margin adjacent each of the apertures which effect transmission of acoustic energy.

With either method of construction illustrated, the conductive layer might also be constituted by a conductive film or foil, applied locally or punched out at the recesses.

Figure 13:
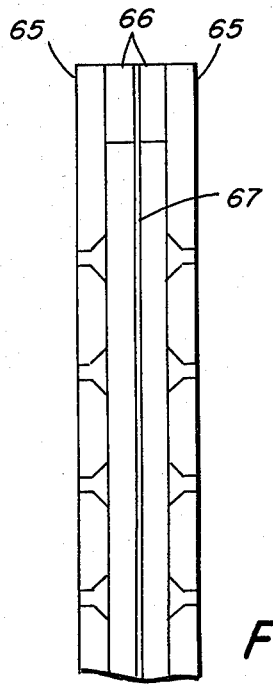
FIG. 13 illustrates an electrostatic transducer assembly utilizing a pair of stationary electrodes constructed as illustrated in FIGS. 7–12.

In the electrostatic transducer illustrated in FIG. 13, a pair of stationary electrodes 65 are utilized, each of which is of the type constructed in accordance with the method illustrated in FIGS. 7–12. Electrodes 65 are mounted in face to face relationship using a pair of spacers 66 which have a movable diaphragm electrode clamped therebetween. Movable diaphragm electrode 67 may, for example, be a stretched plastic film rendered somewhat conductive by the application of a resistive coating. For example, a coating such as that sold under the trademark AQUADAG by the Acheson Colloids Company.

In operation, a d.c. polarizing voltage is applied to the movable electrode and out-of-phase signal voltages are applied to the conductive portions of the two stationary electrodes. The electrostatic forces generated cause the diaphragm electrode 67 to vibrate in correspondence with the signal voltage in conventional manner. Since the stationary electrodes 65 can be constructed with a high degree of flatness and with all conductive portions covered by a high dielectric strength film, close spacings can be used between the stationary and movable electrode with minimal chance of electrical breakdown. As is understood, this close spacing is particularly advantageous to obtain high field strength for a given voltage so that relatively high efficiency is obtained.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A method of forming a stationary electrode for an electrostatic acoustic transducer, said method comprising:

providing a frame including a planar face portion, there being a plurality of recesses distributed over said face portion;

coating selected areas of said face portion only with a conductive layer, avoiding said recesses;

coating said face portion, including the margins of said recesses, with an adhesive;

placing over said face portion a film of a high dielectric strength polymer; and locally distorting said film into each of said recesses so as to wrap the film around the margin of each said recess and to puncture the film centrally in each recess, said film being bonded to said frame by said adhesive.

2. A method as set forth in claim 1 wherein said recesses are essentially straight-sided and said conductive layer is spaced back from said recesses.

3. A method as set forth in claim 1 wherein said recesses include generally conical portions adjacent said face, which conical portions from the margin around each recess.

4. A method of forming a stationary electrode for an electrostatic acoustic transduucer, said method comprising:

providing a frame including a planar face portion, there being a plurality of recesses distributed over said face portion;

applying to selected areas of said face portion a conductive layer, avoiding said recesses;

bonding to said face portion a film of a high dielectric strength polymer; and locally distorting said film into each of said recesses so as to wrap the film around the margin of each said recess and to puncture the film centrally in each recess.

5. A method as set forth in claim 4 wherein said conductive layer is screened onto said face.

6. A method as set forth in claim 4 wherein said conductive layer is rolled onto said face.

7. A method as set forth in claim 4 wherein said conductive layer is a film or foil bonded onto said face.

8. A method of forming a stationary electrode for an electrostatic acoustic transducer, said method comprising:

providing a plastic frame base including a planar face, there being a plurality of generally conical recesses distributed over said face portion;

coating selected areas of said face portion only with a conductive layer, avoiding said recesses;

coating said face portion including the margins of said recesses with an adhesive;

placing over said face portion of said frame a film of a high dielectric strength polymer; and applying, to the covered face of said frame, a two stage tool including a generally conical annular portion which locally distorts said film into contact with each recess and including also a central portion which pierces the film centrally in each recess.

9. A method as set forth in claim 8 wherein the recesses in said frame are initially closed and wherein the central portion of said tool punches through the bottom of the recess.

10. A method of forming a stationary electrode for an electrostatic transducer, said method comprising:

providing a frame including a planar face portion, there being a plurality of recesses distributed over said face portion;

providing, over said face portion, a film of a high dielectric strength polymer;

providing, intermediate said film and said face portion, a conductive layer which avoids said recesses; and locally distorting said film into each of said recesses so as to wrap the film around the margin of each recess and to puncture the film centrally in each recess.

* * * * *